US008863964B2

(12) United States Patent
Terauchi

(10) Patent No.: US 8,863,964 B2
(45) Date of Patent: Oct. 21, 2014

(54) CRANE

(71) Applicant: IHI Construction Machinery Limited, Yokohama (JP)

(72) Inventor: Tetsuyuki Terauchi, Yokohama (JP)

(73) Assignee: IHI Construction Machinery Limited, Kanagawa (JP)

( * ) Notice: Subject to any disclaimer, the term of this patent is extended or adjusted under 35 U.S.C. 154(b) by 0 days.

(21) Appl. No.: 13/975,741

(22) Filed: Aug. 26, 2013

(65) Prior Publication Data

US 2014/0061144 A1 Mar. 6, 2014

(30) Foreign Application Priority Data

Aug. 27, 2012 (JP) ..... 2012-186115

(51) Int. Cl.

*B66C 23/10* (2006.01)
*B66C 23/82* (2006.01)
*B66C 23/70* (2006.01)

(52) U.S. Cl.

CPC ..... *B66C 23/70* (2013.01); *B66C 23/823* (2013.01)
USPC ..... 212/256; 212/299; 212/300; 212/306; 212/240

(58) Field of Classification Search

USPC ..... 212/290, 300, 306, 233, 237, 238, 240, 212/256, 261
See application file for complete search history.

(56) References Cited

U.S. PATENT DOCUMENTS

| | | | | |
|---|---|---|---|---|
| 3,685,668 | A * | 8/1972 | Suverkrop | 212/289 |
| 4,601,402 | A * | 7/1986 | Helm et al. | 212/301 |
| 4,653,656 | A * | 3/1987 | Triplett | 212/307 |
| 7,537,126 | B2 * | 5/2009 | Kurotsu et al. | 212/300 |
| 8,127,949 | B2 * | 3/2012 | Walker et al. | 212/299 |
| 2003/0160016 | A1 * | 8/2003 | Ortiz et al. | 212/300 |
| 2006/0096940 | A1 * | 5/2006 | Willim | 212/300 |
| 2010/0243595 | A1 * | 9/2010 | Walker et al. | 212/294 |

FOREIGN PATENT DOCUMENTS

| | | |
|---|---|---|
| JP | 08-048489 | 2/1996 |

* cited by examiner

*Primary Examiner* — Emmanuel M Marcelo
(74) *Attorney, Agent, or Firm* — Jordan and Hamburg LLP

(57) ABSTRACT

A crane includes: a boom; a jib that is provided on a leading end side of the boom; and a strut that is provided at one or both of a leading end portion of the boom and a base end portion of the jib, and to which a jib support pendant is connected, the strut, to which the pendant is connected, being provided with strut rotationally moving means having: a first bar-like member rotationally connected, at a first end portion thereof on one side, to a leading end portion of the strut on an opposite side thereof to a side, on which the pendant is connected; and a direct acting apparatus that applies, to the first bar-like member, a force pulling the first bar-like member toward the other side along a longitudinal direction of the first bar-like member.

5 Claims, 8 Drawing Sheets

3
4
4a
6
7
10
13
14
14a
15
16
17
18
19
20
21
22
23
24
25
26
27
28
29
30
30a
3a

CRANE

BACKGROUND OF THE INVENTION

1. Field of the Invention

The present invention relates to a crane in which a strut, to which a jib support pendant is connected, is installed at one or both of a leading end portion of a boom and a base end portion of a jib provided on a leading end side of the boom, so that the strut can be rotationally moved in a front-back direction.

2. Description of the Related Art

A luffing crane includes a crane main body including a lower traveling member and an upper slewing member, and a front attachment including a boom (main jib) with a foot thereof attached to the upper slewing member for derricking, a luffing jib (hereinafter simply referred to as a jib) with a foot thereof attached to a leading end portion (boom top) of the boom for rotational movement in an up-down direction, and a jib derricking apparatus.

Base ends of a front strut (also referred to as a front post) and a rear strut (also referred to as a rear post) are attached to the jib derricking apparatus near the foot of the jib or at the boom top and outside a direction in which the jib bends with respect to the boom so that the front strut is located closer to the jib than the rear strut and that the base end portions are rotationally movable in a front-back direction. For the operation and attitude of the struts, a direction in which the strut is proximate to the jib is hereinafter referred to as front, and a direction in which the strut is proximate to the boom is hereinafter referred to as back or rear.

A leading end portion of the front strut is joined to a leading end portion of the jib via a jib supporting leading end side pendant with a length dimension set to a certain value. A leading end portion of the rear strut is connected to a base end portion of the boom via a jib supporting base end side pendant with a length dimension set to a certain value.

Moreover, the leading end portion of the front strut and the leading end portion of the rear strut each include a plurality of sheaves. A jib hoist includes the sheaves of each strut and a wire rope paid out from a jib drum mounted on the crane main body and passed between the sheaves so as to form a plurality of strands.

For the luffing crane, the pieces into which the front attachment is disassembled are normally transported to the site, where the pieces are assembled into the front attachment, which is then attached to the crane main body.

In the assembly of the front attachment, the boom and the jib are sequentially connected to the crane main body on the ground so as to be linearly arranged. Subsequently, the jib derricking apparatus is assembled.

In the assembly of the jib derricking apparatus, first, the base end portions of the front strut and the rear strut are attached to the vicinity of the foot of the jib or to the boom top so as to be rotationally movable in the front-back direction. Then, over the front strut leaned forward along the jib, the rear strut is placed in an angular attitude in which an acute angle is subtended between the front strut and the rear strut. A wiring operation is then performed in which a jib-hoisting wire rope drawn out from the jib drum is passed around the sheaves at the leading end portion of the front strut and the sheaves at the leading end portion of the rear strut.

Then, the rear strut is rotationally moved backward and placed in a backward leaning attitude in which an acute angle is subtended between the rear strut and the boom.

Then, the leading end portion of the backward-leaning rear strut is connected to a second end portion of the base end side pendant with a first end portion thereof connected to the base end portion of the boom, the base end side pendant being disposed above the boom in a slackened manner.

Thereafter, the rear strut is rotationally moved forward to tense the base end side pendant.

After the base end side pendant is tensed, opposite end portions of the leading end side pendant are connected between the leading end portion of the front strut leaned forward along the jib and the leading end portion of the jib.

As means for rotationally moving the rear strut in the front-back direction, a configuration has been proposed in which a cylinder is interposed and attached between a longitudinally intermediate portion of the rear strut and a position on the boom close to the leading end thereof. Such a configuration allows the rear strut to rotationally move forward and backward in conjunction with an extending operation and a contracting operation, respectively, of the cylinder (see, for example, Japanese Patent Application Laid-open No. H8-48489).

However, since the base end side pendant attached between the base end portion of the boom and the leading end portion of the rear strut is set to a certain given length dimension, the tension of the base end side pendant increases rapidly with decreasing degree of slack of the base end side pendant during an operation of rotationally moving the rear strut in the backward leaning angular attitude forward to tense the slack base end side pendant. Thus, when the base end side pendant is tensed, a force needed to rotationally move the rear strut forward gradually increases.

The configuration disclosed in Japanese Patent Application Laid-open No. H8-48489 is such that the rear strut is rotationally moved forward by pushing the longitudinally intermediate portion of the rear strut forward from the rear side by the extending operation of the cylinder interposed between the rear strut and the boom. Thus, when the base end side pendant is tensed, in use of the cylinder the longitudinally intermediate portion of the rear strut needs to be pushed forward by a force in a pushing direction stronger than the tense of the base end side pendant, which acts on the leading end portion of the strut.

Thus, the rear strut is subjected to a heavy bending load by a force exerted on the longitudinally intermediate portion by the cylinder when the base end side pendant is tensed. This leads to the need for a bending strength sufficient to resist the bending load. Hence, disadvantageously, the components of the rear strut correspondingly need to be larger and heavier.

Furthermore, according to the conventional configuration, the cylinder is subjected to a load in a compressing direction as a force reactive to the strong force in the pushing direction, and thus needs to be strong enough to resist buckling.

Thus, an object of the present invention is to provide a crane which can eliminate the need to place a bending load on the longitudinally intermediate portion of the strut when the slack jib support pendant is tensed by rotationally moving the strut connected to the leading end portion of the pendant, which enables a reduction in the structural bending strength of the strut and thus in the weight of the strut, and which can prevent the load in the compressing direction from acting on a member connected to the strut to transmit, to the strut, a force applied by the direct acting apparatus to tense the pendant.

SUMMARY OF THE INVENTION

To achieve the above-described object, an aspect of the present invention provides a crane including: a boom; a jib that is provided on a leading end side of the boom; and a strut that is provided at one or both of a leading end portion of the boom and a base end portion of the jib, and to which a jib support pendant is connected, wherein the strut, to which the pendant is connected, is provided with strut rotationally moving means having: a first bar-like member rotationally connected, at a first end portion thereof on one side, to a leading end portion of the strut on an opposite side thereof to a side on which the pendant is connected; and a direct acting apparatus that applies, to the first bar-like member, a force pulling the first bar-like member toward the other side along a longitudinal direction of the first bar-like member.

According to a second aspect of the invention, in the above-described configuration, the strut rotationally moving means serves as a toggle mechanism in which an articulated portion is pushed and pulled by a force of the direct acting apparatus, this articulated portion being formed by connecting, in a stretchable manner, a second end portion of the first bar-like member, whose first end portion is connected to the leading end portion of the strut, with a second bar-like member which is different from the first bar-like member.

According to a third aspect of the invention, in the above-described configuration, the toggle mechanism pushes and pulls the articulated portion of the first bar-like member and the second bar-like member by means of an articulated-portion-driving toggle-mechanism having two link pieces joined together so as to rotate freely and a direct acting apparatus connected to a joining portion between the link pieces.

According to a fourth aspect of the invention, in the above-described configuration, a first link piece of the two link pieces of the articulated-portion-driving toggle-mechanism which is proximate to the strut provided with the strut rotationally moving means is provided so as to have a rotation center disposed coaxially with a rotation center of the strut, and the first link piece comprises means for removably locking the first link piece on the strut so that the first link piece is rotationally moved integrally with the strut.

A according to a fifth aspect of the invention, in the above-described configuration, the first bar-like member, the first end portion of which is connected to the leading end portion of the strut, comprises a contraction mechanism provided in a middle in the longitudinal direction of the first bar-like member and enabling the first bar-like member to contract all over a length thereof.

The crane according to the present invention exerts the following excellent effects.

(1) In an operation of rotationally moving, after the connection of the pendant, the strut in a direction toward the opposite side of the strut to the side, on which the pendant is connected, to tense the pendant, a heavy bending load can be prevented from acting on the strut. Thus, compared to a conventional case where the longitudinally intermediate portion of the strut is pushed against the tension of the pendant, the aspect of the present invention enables a reduction in the structural bending strength of the strut and in the weight of the strut.

(2) When the pendant is tensed, only a tensile load acts on the bar-like member in a longitudinal direction thereof. This eliminates the need to take into account possible buckling of the first bar-like member caused by compression and allows the bending rigidity of the first bar-like member to be set to a small value, enabling a reduction in the weight of the bar-like member.

(3) The strut rotationally moving means is configured to serve as a toggle mechanism in which the articulated portion is pushed and pulled by the direct acting apparatus, the articulated portion including the first bar-like member with the first end portion thereof connected to the leading end portion of the strut and the second bar-like member connected to the second end portion of the first bar-like member, the first bar-like member and the second bar-like member being connected together in a stretchable manner. This allows a force acting on the articulated portion to be made weaker than a force needed to directly pull the leading end portion of the strut toward the second end side of the first bar-like member along the longitudinal direction thereof against a tension of the pendant. This enables a reduction in a force to be exerted by the direct acting apparatus and thus in the size and weight of the direct acting apparatus.

(4) As means for exerting a pushing and pulling force on the articulated portion of the toggle mechanism in (3), the articulated-portion-driving toggle-mechanism is adopted which includes the two link pieces rotationally movably connected together and the direct acting apparatus connected to the joining portion between the link pieces. This enables a further reduction in the force to be exerted by the direct acting apparatus.

(5) In the articulated-portion-driving toggle-mechanism, the first link piece of the two link pieces which is proximate to the strut with the strut rotationally moving means is provided so as to have the rotation center disposed coaxially with the rotation center of the strut, and the first link piece includes the means for removably locking the first link piece on the strut so that the first link piece is rotationally movable integrally with the strut. Thus, the direct acting apparatus of the strut rotationally moving means can be utilized to rotationally move the strut forward and backward between an attitude in which the strut is leaned in a direction opposite toward the opposite side of the strut to the side, on which the pendant is connected, and an attitude in which the strut leans toward the side of the strut with the pendant connected thereto. Therefore, in the operation of rotationally moving the strut, the position of center of gravity of the strut can be directly controlled, allowing the strut to be stably rotationally moved.

(6) The first bar-like member with the first end portion thereof connected to the leading end portion of the strut includes the contraction mechanism provided in the middle in the longitudinal direction of the first bar-like member and enabling the first bar-like member to contract all over the length thereof. Due to this configuration, when the strut is leaned in a direction toward the opposite side of the strut to the side on which the pendant is connected, it is possible to prevent the bar-lime member from being stretched.

BRIEF DESCRIPTION OF THE DRAWINGS

FIG. 1 shows an embodiment of a crane according to the present embodiment, wherein

FIG. 2 shows an assembly procedure for a jib derricking apparatus of a crane in FIG. 1, wherein

DETAILED DESCRIPTION OF THE INVENTION

Figures 1A, 1B:
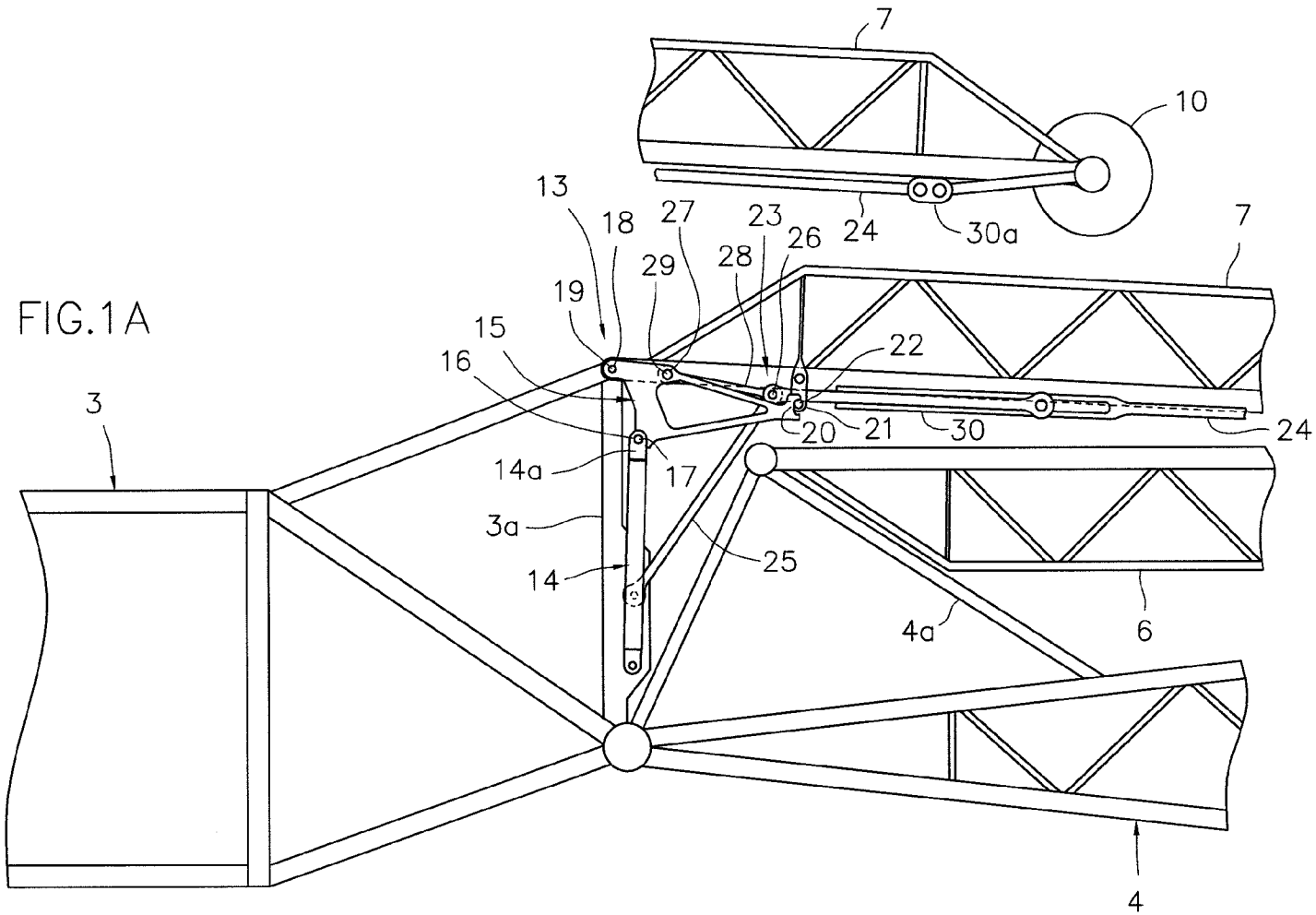
FIG. 1A is a schematic cutaway side view showing the vicinity of a top of a boom.
FIG. 1B is a schematic cutaway side view showing the vicinity of a leading end portion of a rear strut.

Embodiments of the present invention will be described below with reference to the drawings.

FIGS. 1A and 1B to FIG. 5 show an embodiment of a crane according to the present invention.

First, a configuration of a luffing jib crane will be described in brief as an example of the crane according to the present invention.

As shown in an assembled state in FIGS. 2A, 2B, 2C, and 2D, the luffing crane includes a crane main body 1 with a lower traveling member 1*a* and an upper slewing member 1*b* and a front attachment 2 attached to the crane main body 1 and including a boom 3, a jib 4, and a jib derricking apparatus 5.

The jib derricking apparatus 5 includes a front strut 6 with a base end portion thereof attached to a support frame 4*a* provided at a foot of the jib 4 so that the base end portion is rotationally movable in a front-back direction, and a rear strut 7 with a base end portion thereof attached to a support frame 3*a* provided at a top of the boom 3 so that the base end portion is rotationally movable in a front-back direction.

Moreover, the front strut 6 is connected to a leading end portion of the jib 4 at a leading end portion of the front strut 6 via a jib supporting leading end side pendant (not shown in the drawings) with a length dimension thereof set to a certain value. The rear strut 7 is connected to a base end portion of the boom 3 at a leading end portion of the rear strut 7 via a jib supporting base end side pendant 8 with a length dimension thereof set to a certain value.

A jib hoist 12 includes a sheave 9 provided at the leading end portion of the front strut 6, a sheave 10 provided at the leading end portion of the rear strut 7, and a wire rope 11 paid out from a jib drum (not shown in the drawings) mounted on the crane main body 1 and passed between the sheaves 9 and 10 so as to form a plurality of strands.

In the luffing jib crane configured as described above, assembly of the jib derricking apparatus 5 needs rotational movement of the rear strut 7 in the front-back direction as shown in a procedure shown in FIGS. 2A, 2B, 2C, and 2D.

Thus, the rear strut 7 of the jib derricking apparatus 5 includes such a jib derricking apparatus assembly apparatus (hereinafter referred to as an assembly apparatus) 13 as shown in FIG. 1, as means for rotationally moving the rear strut 7 forward and backward between an attitude in which the rear strut 7 is leaned toward the jib 4 side opposite to a side of the rear strut 7 with the base end side pendant 8 connected thereto and a backward leaning attitude in which the rear strut 7 leans toward the side of the rear strut 7 with the base end side pendant 8 connected thereto.

A base end portion of a cylinder 14 serving as a direct acting apparatus is attached to the assembly apparatus 13 at a certain distance from a position on a support frame 3*a* on the boom 3 side where the base end portion of the rear strut 7 is attached toward a position on the support frame 3*a* where a foot of the jib 4 is attached so that the base end portion can swing in the front-back direction.

A leading end portion of an actuation rod (piston rod) 14*a* of the cylinder 14 is joined to a link plate 15 serving as a link piece with a substantially triangular cross section as shown in FIG. 1. The actuation rod 14*a* is joined to the link plate 15 by being attached, via a pin 17, into a first pin hole 16 formed in a first corner portion of the link plate 15 positioned on a lower end side in the attitude shown in FIG. 1 so that the actuation rod 14*a* can move rotationally in the front-back direction.

The link plate 15 shaped substantially like a triangle includes a second pin hole 18 formed in a second corner portion of the link plate 15 positioned above the first corner portion in the attitude shown in FIG. 1. A pin 19 is passed through the second pin hole 18 at a position on the support frame 3*a* on the boom 3 side which position is coaxial with the position (rotation center) where the rear strut 7 is attached so as to allow the link plate 15 to be attached so as to be rotationally movable in the front-back direction.

Moreover, the link plate 15 includes an engagement recess portion 20 formed in a third corner portion that projects forward (a direction away from the boom 3) in the attitude shown in FIG. 1. The engagement recess portion 20 can be locked around an engagement pin 22 removably installed on a bracket 21 provided at a position on the rear strut 7 closer to the base end portion thereof.

Thus, the link plate 15 is rotationally moved in the front-back direction around the pin 19, which is suitable for the second pin hole 18, by locking the engagement recess portion 20 over the engagement pin 22 attached to the bracket 21 for the rear strut 7 and moving the portion of the rear strut 7 closer to the base end portion thereof in the front-back direction. In this state, the first pin hole 16 in the link plate 15 with the actuation rod 14*a* of the cylinder 14 connected thereto is located offset from a longitudinal direction of the rear strut 7.

Thus, in the state shown in FIG. 1, an extending operation of the cylinder 14 allows the portion of the link plate 15 from the second pin hole 18 to the first pin hole 16 to function as a lever attached to the vicinity of rotation center of the rear strut 7, enabling the rear strut 7 to rotationally move backward. On the other hand, a contracting operation of the cylinder 14 allows the rear strut 7 to rotationally move forward along with the link plate 15. Moreover, the portion of the link plate 15 between the first pin hole 16 and the second pin hole 18, which functions as a lever, is located in the vicinity of rotation center of the rear strut 7. Thus, even with small extending and contracting strokes of the cylinder 14, the rear strut 7 can be rotationally moved over a wide angular range in the front-back direction from an attitude in which the strut 7 is leaned forward over the jib 4 as shown in FIG. 2A to such a backward leaning attitude as shown in FIG. 2C.

Figure 4:
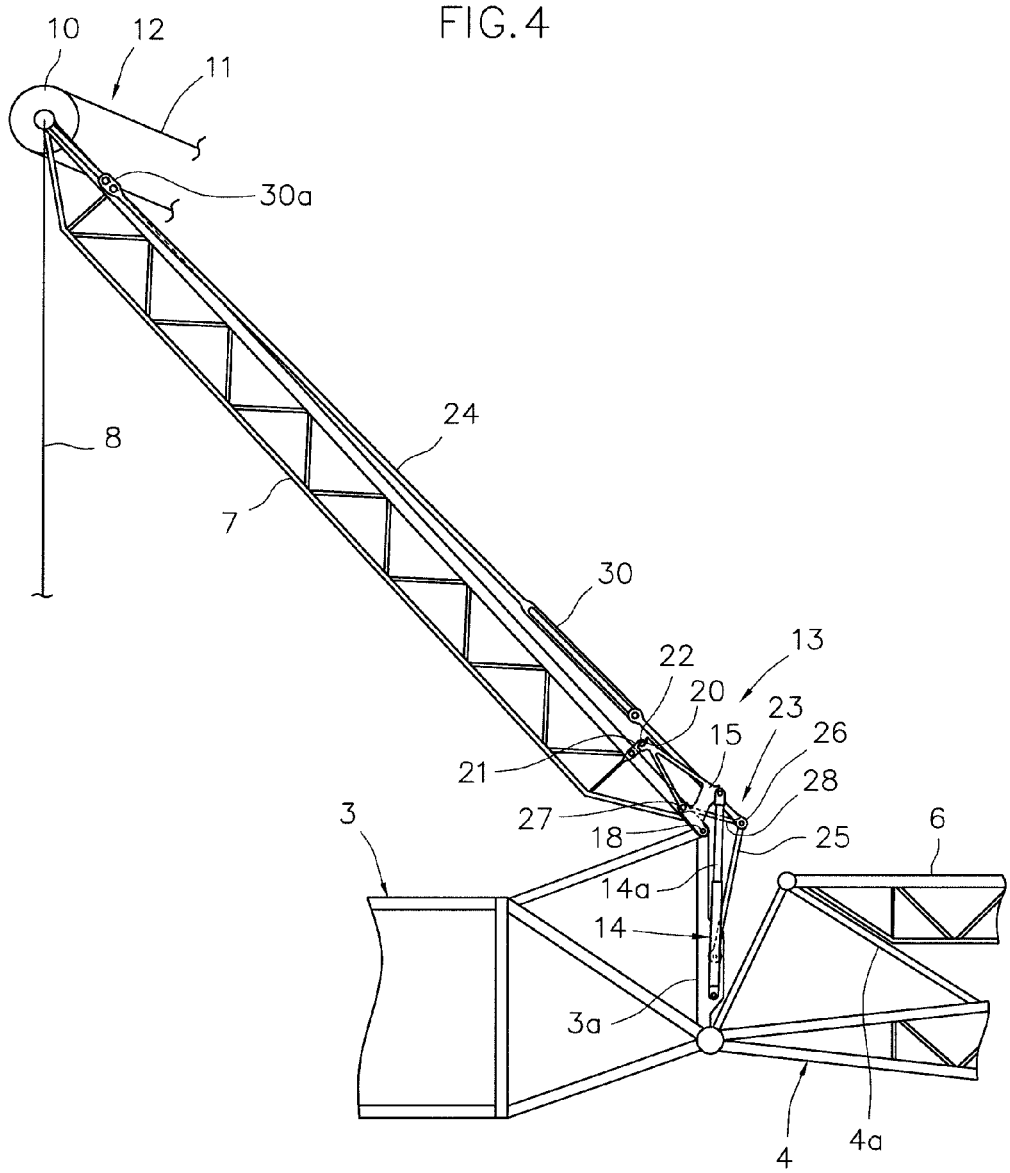
FIG. 4 is a schematic cutaway side view showing the state of the strut rotationally moving means at the point in time in FIG. 2C.
Figure 5:
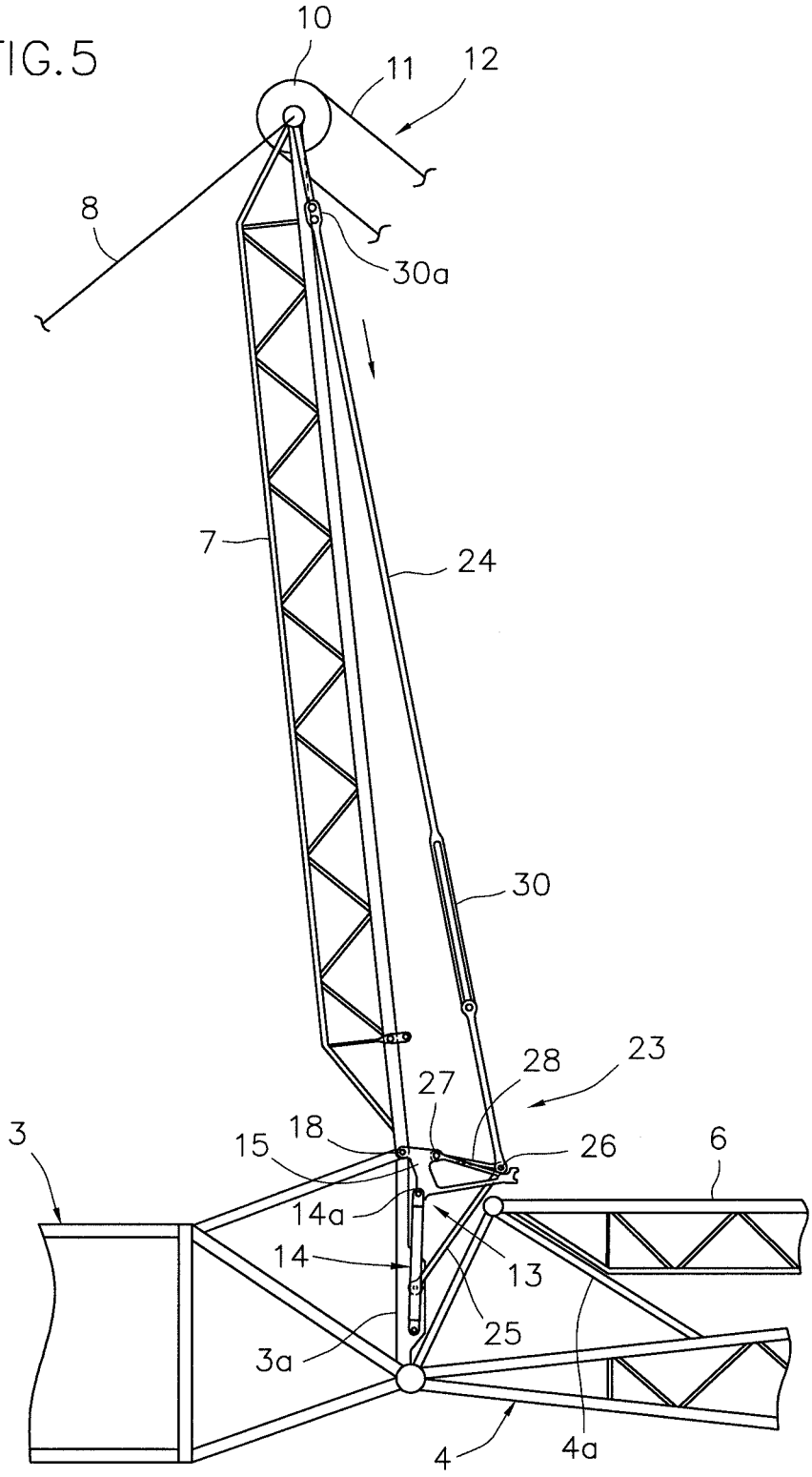
FIG. 5 is a schematic cutaway side view showing the state of the strut rotationally moving means at the point in time in FIG. 2D.

Moreover, as shown in FIG. 1, FIG. 4, and FIG. 5, the rear strut 7 includes strut rotationally moving means 23 having a bar-like member having a first end portion connected to a side of the rear strut 7 at the leading end portion thereof on the opposite side of the rear strut 7 to the side on which the base end side pendant 8 is connected, that is, the opposite side being the front side. As shown in FIG. 4 and FIG. 5, the strut rotationally moving means 23 pulls the bar-like member toward a second end portion thereof along a longitudinal direction thereof to rotationally move forward the rear strut 7 in a backward leaning attitude as shown in FIG. 2C in which the base end side pendant 8 is connected to the leading end portion of the rear strut 7, thus tensing the base end side pendant 8 as shown in FIG. 2D. The strut rotationally moving means 23 is installed on the rear strut 7 as an integral structure sharing the cylinder 14 and the link plate 15 with the assembly apparatus 13.

That is, the strut rotationally moving means 23 includes, for example, as the bar-like member, a first link bar 24 having an overall length slightly larger than the overall length of the rear strut 7, and one end in the longitudinal direction thereof is connected to a front end of the leading end portion of the rear strut 7 so that the first link bar 24 is rotationally movable in the front-back direction.

Furthermore, a first end portion of a second link bar 25 serving as a different bar-like member is connected, for rotational movement in the front-back direction, to a position at a certain distance from a position on the support frame 3*a* at the top of the boom 3 where the base end portion of the rear strut 7 is attached toward a position on the support frame 3*a* where a foot of the jib 4 is attached. Second end portions of the first link bar 24 and the second link bar 25 are joined together via a joining pin 26 in a stretchable manner. As shown in FIG. 4, the length dimensions of the first link bar 24 and the second link bar 25 are assumed to be set such that, when the rear strut 7 is leaned backward, a stretchable articulated portion of the link bars 24 and 25 joined together via the joining pin 26 is located a certain distance in front of the base end portion of the rear strut 7 or the support frame 3*a* on the boom 3 side.

Moreover, the articulated portion of the link bars 24 and 25 includes means for displacing the articulated portion in a direction in which the articulated portion is made closer to or separated from the support frame 3*a* of the boom 3. A toggle mechanism for rotationally moving the whole rear strut 7 forward is formed by pulling the leading end portion of the rear strut 7 in a longitudinal direction of the first link bar 24 in conjunction with displacement of the articulated portion of the link bars 24 and 25 in a direction in which the articulated portion is separated from the support frame 3*a* on the boom 3 side, that is, the forward displacement of the articulated portion by the means for displacing the articulated portion of the link bars 24 and 25.

For example, as shown in FIG. 1, FIG. 4, and FIG. 5, the means for displacing the articulated portion of the link bars 24 and 25 includes a third pin hole 27 formed in an intermediate portion between the second pin hole 18 in the link plate 15 and the third corner portion with the engagement recess portion 20 and a third link bar 28 serving as a link piece with a first end portion thereof connected to the pin hole 27 via a pin 29 so that the third link bar 28 is rotationally movable in the front-back direction. A second end portion of the third link bar 28 is rotationally movably joined to the joining pin 26 joining second end portions of the first and second link bars 24 and 25 together.

Thus, when the engagement pin 22 installed in the bracket 21 of the rear strut 7 is removed to unlock the engagement recess portion 20 of the link plate 15 from the bracket 21, a contracting operation of the cylinder 14 rotationally moves the link plate 15 forward around the second pin hole 18. When the link plate 15 rotationally moves forward, a part positioned between the second pin hole 18 and the third pin hole 27 (hereinafter referred to as the part of the link plate 15) functions as a link. Thus, serving as the link, the part of the link plate 15 and the third link bar 28 both in a bent state stretch, and this allows formation of an articulated-portion-driving toggle-mechanism for pushing and displacing the articulated portion of the first and second link bars 24 and 25 in a direction in which the articulated portion is separated from the support frame 3*a* of the boom 3.

The length dimensions of the part of the link plate 15 and the third link bar 28, functioning as links, are set such that a contracting operation of the cylinder 14 allows the rear strut 7 to be placed in an attitude in which the base end side pendant 8 connected to the leading end portion of the rear strut 7 is tensed, via the articulated-portion-driving toggle-mechanism with the part of the link plate 15 and the third link bar 28 and the toggle mechanism with the first and second link bars 24 and 25, driven by the articulated-portion-driving toggle-mechanism, as shown in FIG. 5. The length dimensions of the part of the link plate 15 and the third link bar 28 in the articulated-portion-driving toggle-mechanism, functioning as links, are set such that, when the base end side pendant 8 is tensed, a direction in which the part of the link plate 15 extends is approximately aligned with a longitudinal direction of the third link bar 28 (this attitude is hereinafter referred to as a specific attitude). In such a configuration, when the rear strut 7 with the base end side pendant 8 connected thereto is rotationally moved forward to contract the cylinder 14 to shift a state shown in FIG. 4 to a state shown in FIG. 5, a timing when the tension of the base end side pendant 8 increases rapidly with decreasing degree of slack of the base end side pendant 8 can be made equal to a timing when the articulated-portion-driving toggle-mechanism becomes closer to the specific state.

Moreover, in the state shown in FIG. 5, the articulated-portion-driving toggle-mechanism is placed in the specific attitude and can thus hold the attitude of the toggle mechanism with the first and second link bars 24 and 25 by means of the part of the link plate 15 and the third link bar 28, approximately aligned with each other, without allowing the cylinder 14 to exert any force. This eliminates the need for power for holding the attitude of the rear strut 7 even with the tension of the base end side pendant 8 acting on the leading end side of the rear strut 7.

Figure 2A:
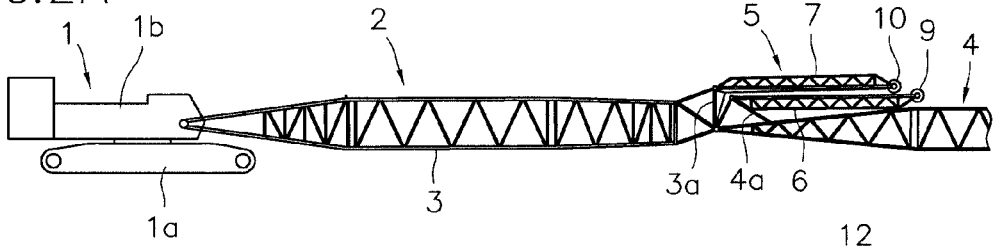
FIG. 2A is a schematic side view showing an initial state in which assembly of the jib derricking apparatus is started.

As shown in FIG. 1 and FIG. 2A, the first link bar 24 includes a contraction mechanism 30 in the middle of the link bar 24 in its longitudinal direction to enable the first link bar 24 to contract all over the length thereof, so as to prevent the first link bar 24 from stretching and causing an obstacle when the rear strut 7 is leaned forward over the jib 4. The first link bar 24 further includes, as shown in FIG. 1B, an articulation 30*a* which is disposed in the middle of the first link bar 24 in its longitudinal direction and which can bend within a certain angular range, so as to prevent the first link bar 24 from interfering with the rear strut 7 and ancillary devices thereof (not shown in the drawings), in a state where a force of pulling the leading end of the rear strut 7 in the longitudinal direction of the first link bar 24 is not applied.

When the jib derricking apparatus 5 is assembled in the crane according to the embodiment the present invention including the strut rotationally moving means 23 integrated with the assembly apparatus 13 configured as described above, the boom 3 and the jib 4, forming the front attachment 2, are preliminarily sequentially joined to the crane main body 1, as shown in FIG. 2A. Moreover, the base end portion of the rear strut 7 is attached to the support frame 3*a* on the boom 3 side, and the front strut 6 is attached to the support frame 4*a* on the jib 4 side. In this case, as shown in FIG. 1 and FIG. 2A, the rear strut 7 is leaned forward over the jib 4 along with the front strut 6.

Moreover, in the assembly apparatus 13, the engagement recess portion 20 of the link plate 15 is pre-locked around the engagement pin 22 installed on the corresponding bracket 21 of the rear strut 7.

Figure 2B:
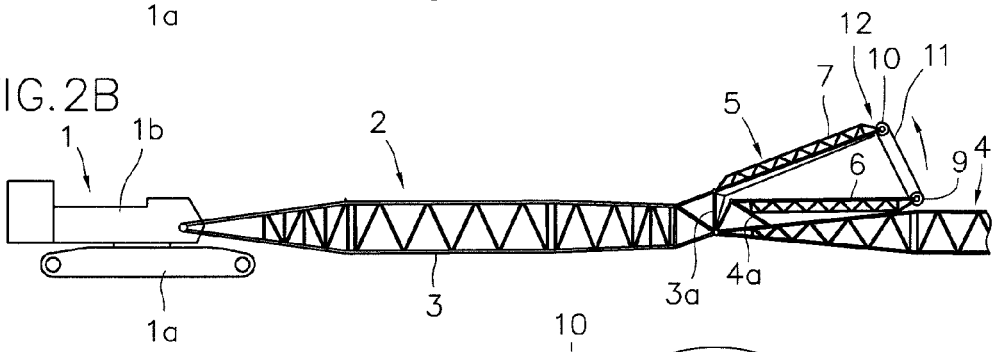
FIG. 2B is a schematic side view showing that a jib hoisting wire rope is passed between a sheave at the leading end portion of the rear strut and a sheave at a leading end portion of a front strut.
Figure 2C:
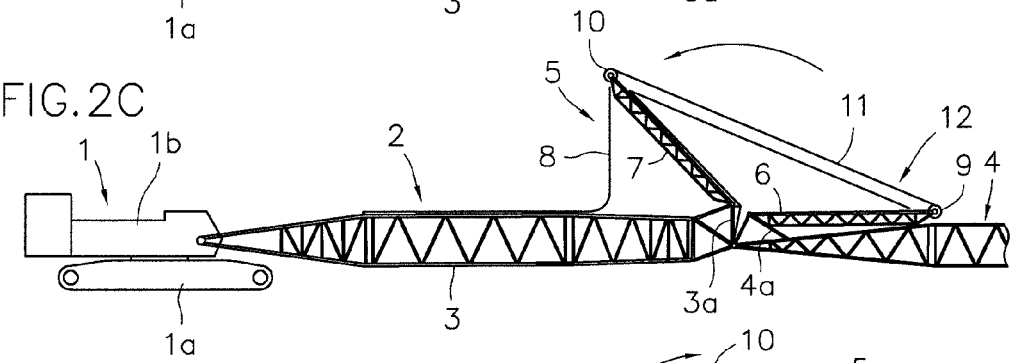
FIG. 2C is a schematic side view showing that the rear strut is leaned backward to connect to a base end side pendant.
Figure 2D:
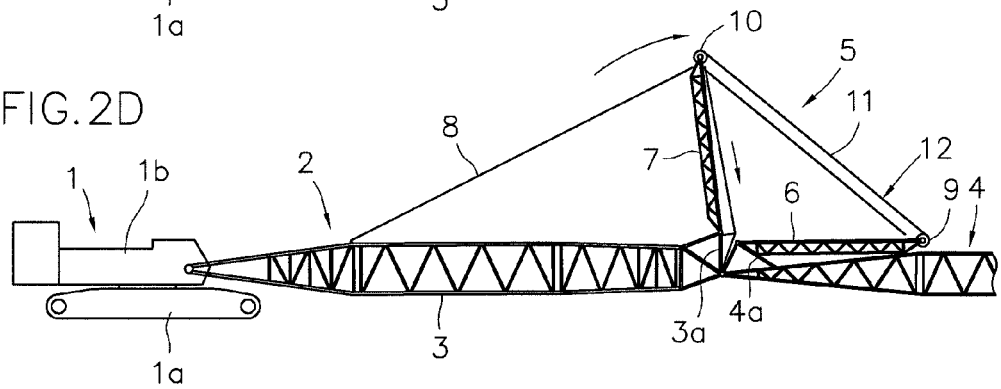
FIG. 2D is a schematic side view showing that the rear strut is rotationally moved forward to tense the base end side pendant.
Figure 3:
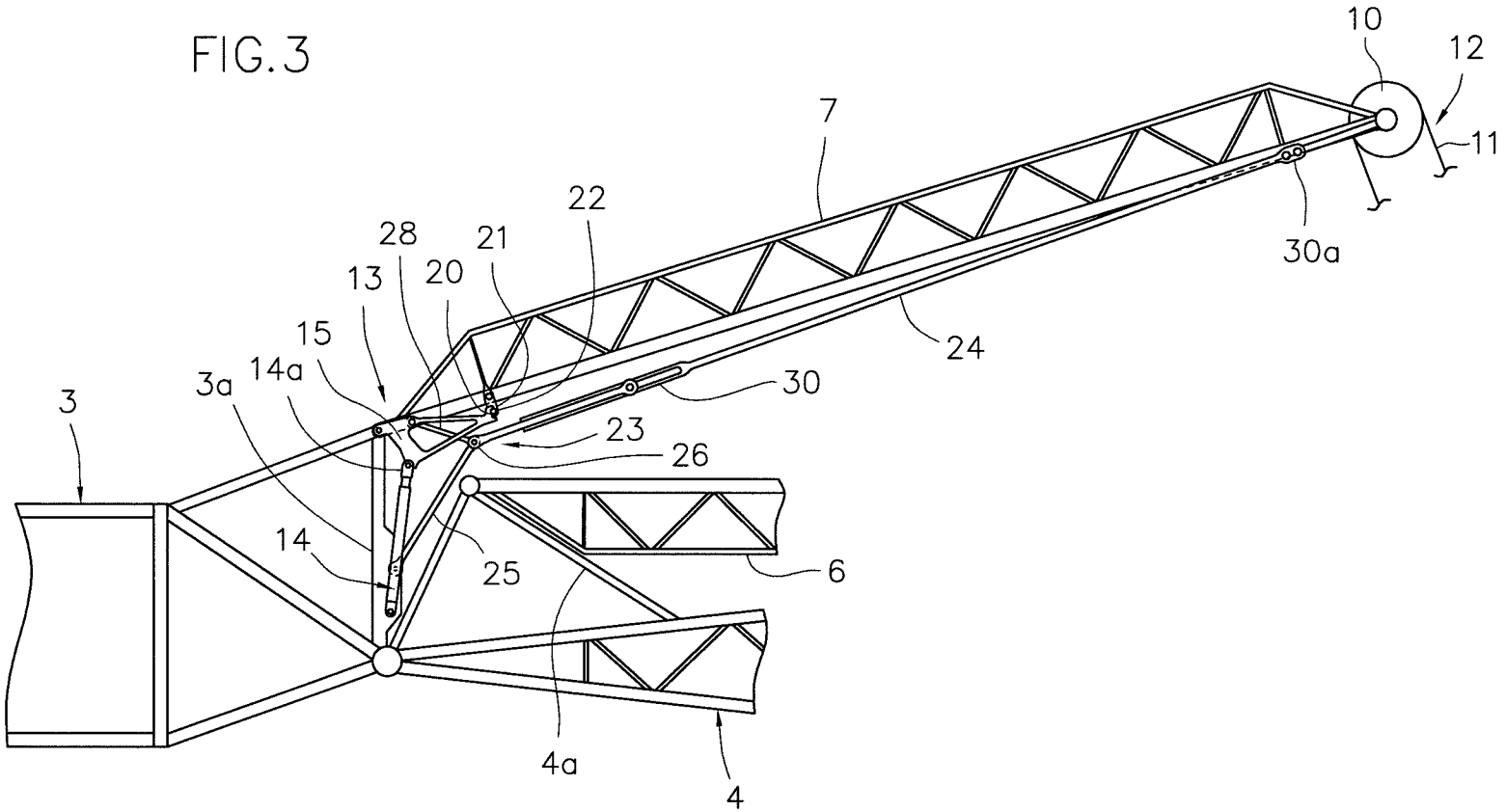
FIG. 3 is a schematic cutaway side view showing the state of strut rotationally moving means at the point in time in FIG. 2B.

In the above-described initial state, when the assembly of the jib derricking apparatus 5 is started, first, the cylinder 14 is extended by a certain distance as shown in FIG. 3, and the rear strut 7 is rotationally moved backward integrally with the link plate 15 to raise the leading end portion of the rear strut 7 to a position where a certain gap is formed between the leading end portion of the front strut 6 and the leading end portion of the rear strut 7 as shown in FIG. 2B and FIG. 3.

Thus, a gap is formed between the sheave 10 at the leading end portion of the rear strut 7 and the sheave 9 at the leading end portion of the front strut 6. In this state, a wiring operation is performed in which the wire rope 11 for the jib hoist 12 paid out from the jib drum (not shown in the drawings) on the crane main body 1 is passed between the sheaves 9 and 10 of the front and rear struts 6 and 7 so as to form a predetermined number of strands.

Then, as shown in FIG. 4, the cylinder 14 is further contracted to rotationally move the rear strut 7 backward integrally with the link plate 15 to place the rear strut 7 in an attitude in which the rear strut 7 leans at a predetermined angle as shown in FIG. 2C and FIG. 4. At this time, the wire rope 11 for the jib hoist 12 is properly paid out according to an increase in the distance between the rear strut 7 and the front strut 6 associated with the backward leaning of the rear strut 7.

When the rear strut 7 is placed in the backward leaning attitude as described above, an upper ends portion of the rear strut 7 is connected to the second end portion of the base end side pendant 8 disposed over the boom 3 in a slackened manner with the first end portion thereof connected to the base end portion of the boom 3.

Then, the engagement pin 22 around which the engagement recess portion 20 of the link plate 15 is locked is removed from the bracket 21. Thus, the link plate 15 is unlocked from the rear strut 7. This allows the load of the rear strut 7 to be received by, instead of the link plate 15, the toggle mechanism with the first and second link bars 24 and 25 of the strut rotationally moving means 23 and the articulated-portion-driving toggle-mechanism including the part of the link plate 15 and the third link bar 28 and configured to drive the articulated portion (the articulated portion of the link bars 24 and 25 joined together via the joining pin 26) of the toggle mechanism by the cylinder 14.

Subsequently, in the operation of the strut rotationally moving means 23, the cylinder 14 is contracted as shown in FIG. 5. Thus, the articulated-portion-driving toggle-mechanism including the part of the link plate 15 and the third link bar 28 displaces the articulated portion of the toggle mechanism including the first and second link bars 24 and 25 forward. The first link bar 24 correspondingly pulls the leading end portion of the rear strut 7 in a direction along the first link bar 24. Thus, the rear strut 7 is rotationally moved forward to tense the base end side pendant 8 connected to the leading end portion of the rear strut 7.

After the base end side pendant 8 is tensed as described above, opposite end portions of the leading end side pendant (not shown in the drawings) may be connected between the leading end portion of the front strut 6 leaning forward along the jib 4 and the leading end portion of the jib 4 to complete the assembly of the jib derricking apparatus 5 as in the conventional art.

The jib derricking apparatus 5 may be disassembled by carrying out a procedure reverse to the assembly procedure.

Thus, according to the crane according to the present invention, when an operation is performed in which the rear strut 7 with the base end side pendant 8 connected thereto is rotationally moved forward to tense the base end side pendant 8, the strut rotationally moving means 23 pulls the leading end portion of the rear strut 7 forward. This prevents a heavy bending load from acting on the rear strut 7. Thus, the embodiment of the present invention enables a reduction in the structural bending strength of the rear strut 7 compared to the conventional technique in which the base end side pendant 8 is pushed forward at a middle position thereof against the tension of the base end side pendant 8 to tense the base end side pendant 8. Hence, the weight of the rear strut 7 can be reduced.

Furthermore, the first link bar 24, which pulls the leading end portion of the rear strut 7 forward against the tension of the base end side pendant 8, is subjected only to a tensile load in the longitudinal direction of the first link bar 24. This eliminates the need to take into account possible buckling of the first link bar 24 caused by compression and allows the bending rigidity of the first link bar 24 to be set to a small value, enabling a reduction in the weight of the first link bar 24.

The above-described configuration uses the toggle mechanism configured to push the articulated portion of the first link bar 24 and the second link bar 25 in order to pull the leading end portion of the rear strut 7 forward. Thus, a force exerted forward on the articulated portion of the link bars 24 and 25 can be reduced below a force needed to pull the leading end portion of the rear strut 7 to the second end portion of the first link bar 24 along the longitudinal direction thereof against the tension of the base end side pendant 8.

Moreover, as means for pushing the articulated portion of the first and second link bars 24 and 25, the articulated-portion driving toggle-mechanism is used which includes the third link bar 28 and the part of the link plate 15 rotationally moving the articulated portion by the contracting operation of the cylinder 14. Thus, a force needed for the contracting operation of the cylinder 14 can be made further weaker than a force pushing the articulated portion of the first and second link bars 24 and 25 to pull the leading end portion of the rear strut 7 against the tension of the base end side pendant 8. Therefore, the cylinder 14 is subjected only to a load in a pulling direction when the rear strut 7 is rotationally moved forward to tense the base end side pendant 8. This eliminates the need to take possible buckling of this member into account and allows the bending rigidity of the member to be set to a small value.

Furthermore, the articulated-portion driving toggle-mechanism becomes closer to the toggle mechanism at a timing when the tension of the base end side pendant 8 increases rapidly in conjunction of the forward rotational movement of the rear strut 7 with the base end side pendant 8 connected thereto. Thus, a force exerted by the cylinder 14 via the articulated-portion driving toggle-mechanism can be varied (increased) depending on a variation (increase) in a force needed during the forward rotational movement of the rear strut 7 with the base end side pendant 8 connected thereto. Therefore, the cylinder 14 need not have an excessive margin for the force exerted by the cylinder 14 itself and can thus have a smaller size and a lighter weight than a conventional cylinder configured to push the rear strut 7 forward at a longitudinally middle position thereof against the tension of the base end side pendant 8. Consequently, the crane according to the present invention enables a reduction in costs needed for the cylinder 14.

Moreover, in the specific state as shown in FIG. 5, the articulated-portion-driving toggle-mechanism can hold the attitude of the toggle mechanism with the first and second link bars 24 and 25 without the need for the force of the cylinder 14, allowing maintenance of the attitude of the rear strut 7 with the base end side pendant 8 tensed.

The assembly apparatus 13 is integrated with the strut rotationally moving means 23 and thus enables both of the following functions to be carried out utilizing the cylinder 14 used by the strut rotationally moving means 23: the function to rotationally move the rear strut 7 forward to tense the base end side pendant 8 and the function to rotationally move the rear strut 7 backward into the backward leaning attitude during a step preceding the step of forward rotational movement. When the rear strut 7 is thus leaned backward, only the weight of the rear strut 7 acts and no strong force in the pushing direction needs to be exerted in order to resist a strong force such as the tension of the base end side pendant 8. Furthermore, when the jib derricking apparatus 5 is disassembled, the assembly apparatus 13 rotationally moves forward the backward-leaning rear strut 7 from which the base end side pendant 8 has been removed, from the backward leaning attitude to the attitude in which the rear strut 7 is leaned forward over and along the jib 4. Also at this time, only the weight of the rear strut 7 acts on the assembly apparatus 13. Thus, the force exerted by the cylinder 14 and the size of the cylinder 14 can be reduced below the force and size of the conventional cylinder without any problem as described above.

Furthermore, in the crane according to the present invention, the cylinder 14 included in the assembly apparatus 13 performs the operation of rotationally moving the rear strut 7 with the base end side pendant 8 not connected thereto forward and backward between the attitude in which the rear strut 7 is leaned forward toward the jib 4 side and the backward leaning attitude as described above. Thus, when the forward-leaning rear strut 7 is leaned backward and when the rear strut 7 is rotationally moved in the opposite direction, the position of center of gravity of the rear strut 7 can be directly controlled. This enables more stable movement than a case where the rear strut 7 is suspended and leaned backward by an accompanying machine.

Figure 8:
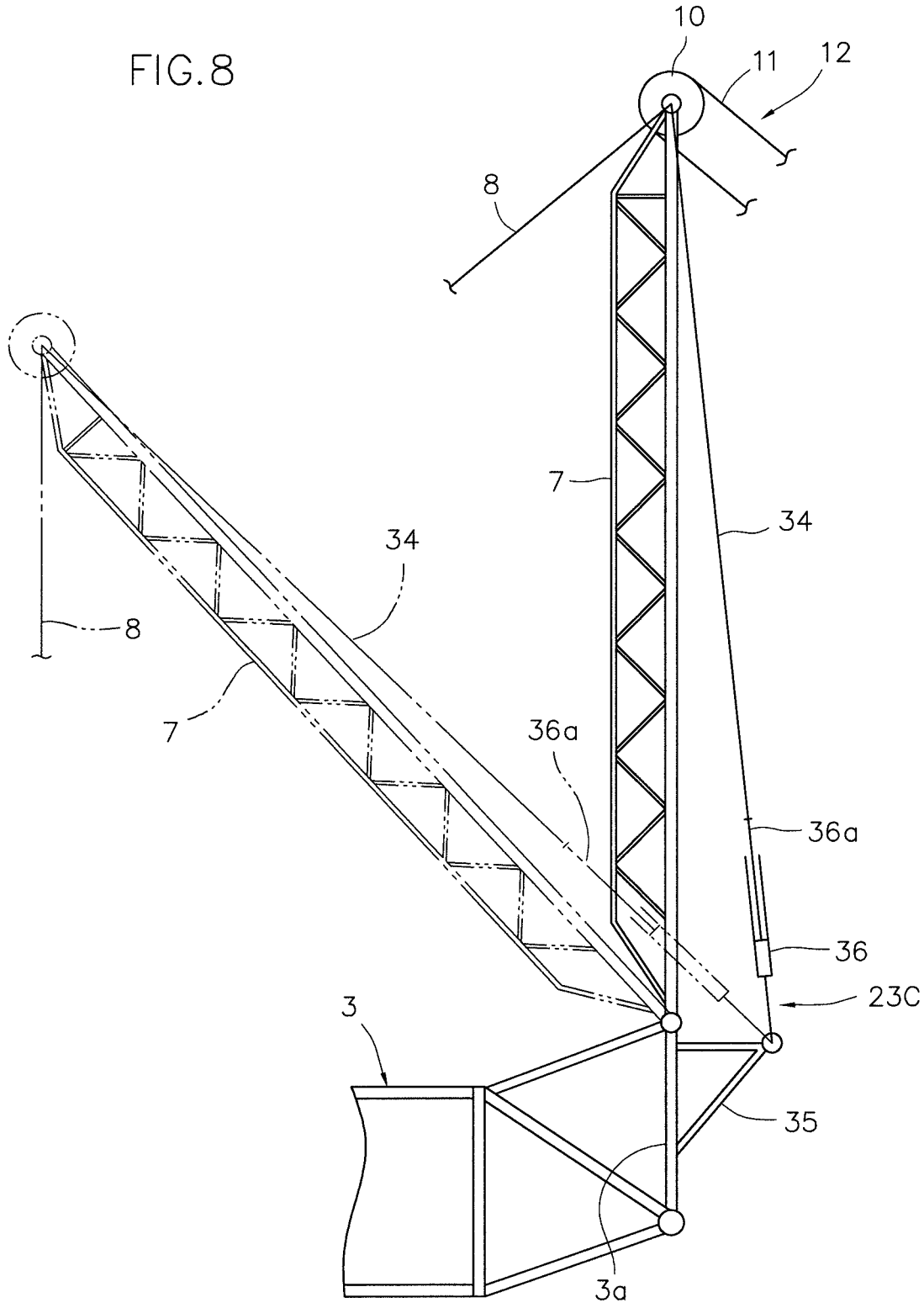
FIG. 8 is a schematic diagram showing another example of the strut rotationally moving means as still another embodiment of the present invention.

In the above-described embodiment, the crane according to the present invention includes the strut rotationally moving means 23 integrated with the assembly apparatus 13 so as to enable both of the following functions to be carried out using the common cylinder 14: the function to rotationally move the rear strut 7 forward to tense the base end side pendant 8 and the function to rotationally move the rear strut 7 backward into the backward leaning attitude during the step preceding the step of forward rotational movement. However, if the operation of leaning the rear strut 7 backward is performed by an accompanying machine or a cylinder different from the cylinder used to rotationally move the rear strut 7 forward to tense the base end side pendant 8, the crane according to the present invention may exclusively include the strut rotationally moving means 23 having only the function to rotationally move the rear strut 7 to tense the base end side pendant 8 as shown in FIG. 6 and FIG. 8.

Figure 6:
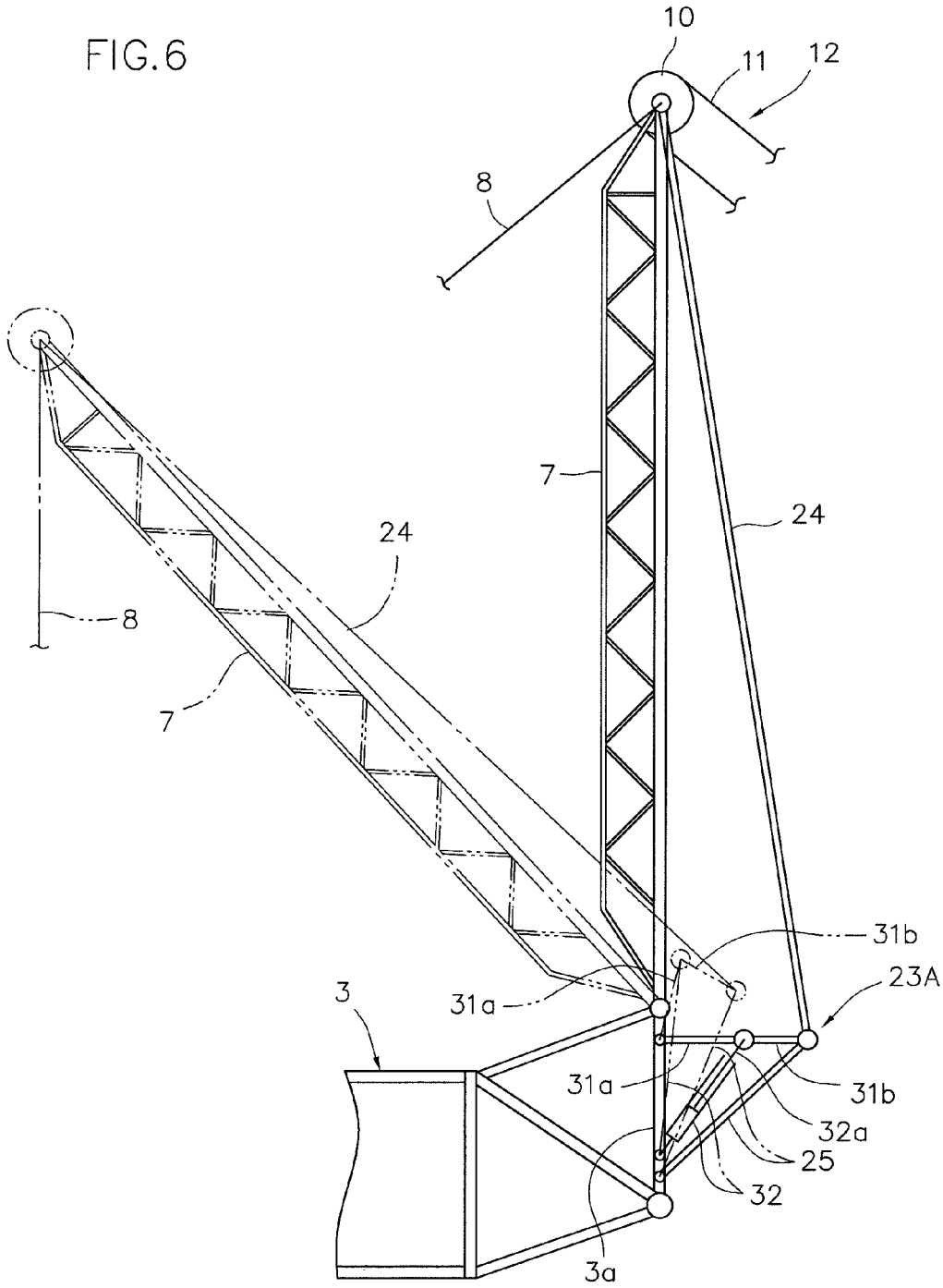
FIG. 6 is a schematic diagram showing another example of the strut rotationally moving means as another embodiment of the present invention.

FIG. 6 shows another example of the strut rotationally moving means according to another embodiment of the present invention.

As shown by reference numeral 23A in FIG. 6, the strut rotationally moving means according to the present embodiment is configured similarly to the strut rotationally moving means 23 shown in FIGS. 1A and 1B to FIG. 5. The strut rotationally moving means 23A includes an articulated-portion-driving toggle-mechanism with two link pieces 31*a* and 31*b* rotationally movably connected together and a cylinder 32 including an actuation rod 32*a* connected to a stretchable joining portion between the link pieces 31*a* and 31*b* and serving as a direct acting apparatus, instead of an articulated-portion-driving toggle-mechanism with a cylinder 14, a link plate 15, and a third link bar 28, between a support frame 3*a* at a top of a boom 3 and an articulated portion between a first link bar 24 and a second link bar 25 of a toggle mechanism.

A base end portion of the cylinder 32 is rotationally movably supported by the support frame 3*a* on the boom 3 side.

The link pieces 31*a* and 31*b* included in the articulated-portion-driving toggle-mechanism have length dimensions set such that a contracting operation of the cylinder 32 allows a rear strut 7 to be placed, via a toggle mechanism with the first and second link bars 24 and 25 driven by the articulated-portion-driving toggle-mechanism, into an attitude in which a base end side pendant 8 connected to a leading end portion of the rear strut 7 is tensed, as shown in FIG. 6. The link pieces 31*a* and 31*b* are set such that, when the base end side pendant 8 is tensed, the link pieces 31*a* and 31*b* are placed in a specific attitude in which the link pieces 31*a* and 31*b* are approximately aligned with each other.

Figure 7:
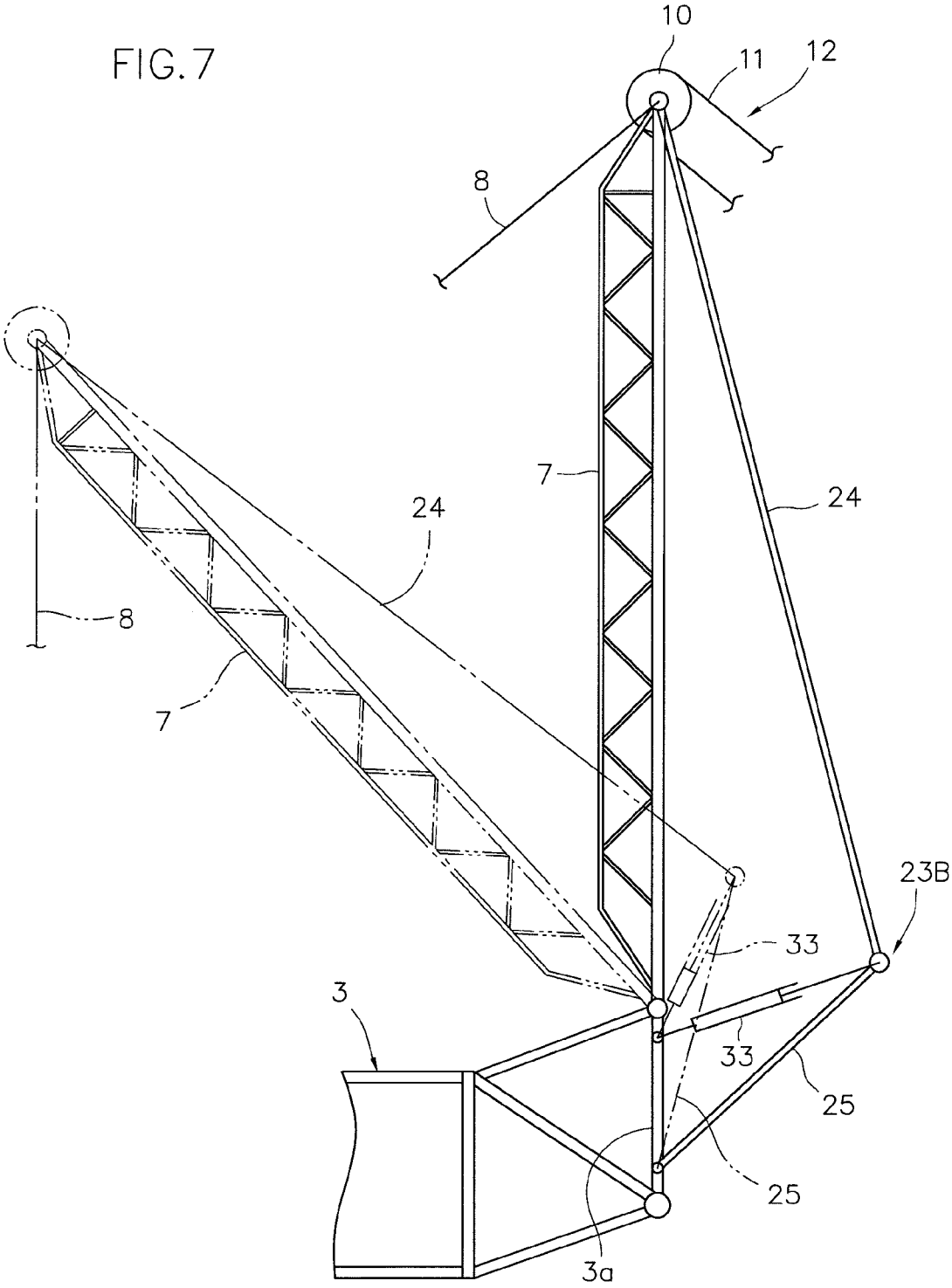
FIG. 7 is a schematic diagram showing another example of the strut rotationally moving means as yet another embodiment of the present invention.

For convenience of illustration, a jib 4 connected to the top of the boom 3 and members connected to the jib 4 are omitted (this also applies to FIG. 7 and FIG. 8). The other components are similar to the corresponding components shown in FIGS. 1A and 1B to FIG. 5, and the same components are denoted by the same reference numerals.

The crane according to the present invention including the strut rotationally moving means 23A according to the present embodiment can exert effects similar to the effects of the embodiment shown in FIGS. 1A and 1B to FIG. 5 except an effect that enables the following functions to be carried out using a common cylinder: the function to rotationally move the rear strut 7 forward to tense the base end side pendant 8 and the function to rotationally move the rear strut 7 with the base end side pendant 8 not connected thereto forward and backward between an attitude in which the rear strut 7 is leaned toward the jib 4 side and a backward leaning attitude, and effects associated with the ability to rotationally move the rear strut 7 with the pendant not connected thereto forward and backward as described above.

FIG. 7 shows yet another example of the strut rotationally moving means as yet another embodiment of the present invention.

That is, as shown by reference numeral 23B in FIG. 7, the strut rotationally moving means according to the present embodiment is configured similarly to the strut rotationally moving means 23 shown in FIGS. 1A and 1B to FIG. 5. The strut rotationally moving means 23A includes a cylinder 33 serving as a direct acting apparatus and interposed, instead of an articulated-portion-driving toggle-mechanism, directly between a support frame 3*a* at a top of a boom 3 and an articulated portion between a first link bar 24 and a second link bar 25 of a toggle mechanism.

The other components are similar to the corresponding components shown in FIGS. 1A and 1B to FIG. 5, and the same components are denoted by the same reference numerals.

Similarly to the embodiments shown in FIGS. 1A and 1B to FIG. 5, the crane according to the present invention including the strut rotationally moving means 23B according to the present embodiment is effective in enabling a reduction in the structural bending strength of the rear strut 7 and in the weight of the rear strut 7 compared to the conventional technique. Possible buckling of the first link bar 24 caused by compression need not be taken into account, and the bending rigidity of the first link bar 24 can be set to a small value. This is effective in enabling a reduction in the weight of the first link bar 24.

Furthermore, the toggle mechanism with the link bars 24 and 25 allows a force exerted by the cylinder 33 to push an articulated portion of the toggle mechanism forward to tense a base end side pendant 8 to be made weaker than a force needed to pull a leading end portion of the rear strut 7 directly to a second end portion of the link bar 24 along a longitudinal direction thereof against the tension of the base end side pendant 8.

FIG. 8 shows still another example of the strut rotationally moving means as still another embodiment of the present invention.

That is, as shown by reference numeral 23C in FIG. 8, the strut rotationally moving means according to the present embodiment includes a bar-like member 34 with a first end portion connected to a front end of a leading end portion of a rear strut 7 so as to be rotationally movable in the front-back direction. A second end portion of the bar-like member 34 is connected to an actuation rod 36*a* of a cylinder 36 installed in front of a support frame 3*a* at a top of a boom 3 via a bracket 35 so as to be able to swing in the front-back direction and serving as a direct acting apparatus.

The other components are similar to the corresponding components shown in FIGS. 1A and 1B to FIG. 5, and the same components are denoted by the same reference numerals.

As is the case with the embodiment shown in FIGS. 1A and 1B to FIG. 5, the crane according to the present invention including the strut rotationally moving means 23C according to the present embodiment is effective in enabling a reduction in the structural bending strength of the rear strut 7 and in the weight of the rear strut 7 compared to the conventional technique. The bar-like member 34 has only to bear a load in a pulling direction, eliminating the need to take into account possible buckling of the bar-like member 34 caused by compression and allowing the bending rigidity of the bar-like member 34 to be set to a small value. This is effective in enabling a reduction in the weight of the bar-like member 34.

Furthermore, when the rear strut 7 is rotationally moved forward to tense a base end side pendant 8, the cylinder 36 is subjected only to the load in the pulling direction, eliminating the need to take into account possible buckling of the bar-like member 34 caused by compression and allowing the bending rigidity of the bar-like member 34 to be set to a small value. This enables the size and weight of the cylinder 36 to be reduced below the size and weight of the conventional cylinder used to push an intermediate portion of the rear strut 7 against the tension of the base end side pendant 8. Hence, the embodiment of the present invention enables a reduction in costs needed for the cylinder 36.

The present invention is not limited to the above-described embodiments. The rear strut 7 may be applied to a crane that is supported by a frame attached to the foot side of the jib 4. In this case, the members of the strut rotationally moving means 23, 23A, 23B, or 23C, attached to the support frame 3*a* on the boom 3 side according to the above-described embodiments, may be attached to the frame on the jib 4 side fixed to the position where the rear strut 7 is rotationally movably attached according to the above-described embodiments.

The illustrated lengths and thicknesses of the boom 3, the jib 4, and the front and rear struts 6 and 7 are for convenience of illustration, and the actual dimensions may be properly set.

Furthermore, the size of the link plate 15 and the lengths and thicknesses of the first link bar 24, the second link bar 25, the third link bar 28, and the link pieces 31*a* and 31*b* may be properly changed according to the dimensions of the boom 3, the jib 4, and the front and rear struts 6 and 7.

Additionally, the first link bar 24 according to the embodiments in FIG. 6 and FIG. 7 and the bar-like member 34 according to the embodiment in FIG. 8 may include a contraction mechanism 30 provided in a middle position thereof and which is similar to the contraction mechanism 30 of the first link bar 24 according to the embodiment in FIGS. 1A and 1B and FIG. 5.

In the embodiment in FIGS. 1A and 1B and FIG. 5, any type of locking means other than the engagement recess portion 20 and engagement pin 22 may be used provided that a position on the link plate 15 is removably locked at a corresponding position on the rear strut 7 so that the link plate 15 is rotationally movable integrally with the rear strut 7.

In the above-described embodiments, the strut rotationally moving means 23, 23A, 23B, and 23C are configured to rotationally move the rear strut 7 forward to tense the base end side pendant 8 after the base end side pendant 8 is connected to the leading end portion of the rear strut 7 leaned backward. However, the strut rotationally moving means 23, 23A, 23B, and 23C may be configured to rotationally move the rear strut 7 backward to tense the leading end side pendant (not shown in the drawings) after the second end on the opposite side of the leading end side pendant to the side, on which one end of the leading end side pendant is connected to the leading end portion of the jib 4, is connected to the leading end portion of the front strut 6 leaned forward. In this case, the components of the strut rotationally moving means 23, 23A, 23B, and 23C may be attached to the front strut 6 and the support frame 4*a* on the jib 4 side instead of the rear strut 7 and the support frame 3*a* on the boom 3 side.

The strut rotationally moving means 23, 23A, 23B, and 23C may include a direct acting apparatus such as a ball screw instead of the cylinders 14, 32, 33, and 36.

The present invention is applicable to any type of luffing jib crane such as a type in which the jib drum is provided on an attachment or a mast as long as one or both of the leading end portion of boom 3 and the base end portion of the jib 4 include the front strut 6 and the rear strut 7, to which the jib support pendant is connected, so that the front strut 6 and the rear strut 7 are rotationally movable in the front-back direction. Furthermore, the present invention is applicable to a tower jib crane including a jib provided on a leading end side of a boom and a strut provided at either a leading end portion of the boom or a base end portion of the jib and to which a second end portion of a jib support pendant with a first end portion thereof connected to a leading end side of the jib is connected.

In an applied example of the present invention, wire ropes or other cable-like bodies may replace the first link bar 24 and the second link bar 25 according to the embodiment in FIG. 6 and the embodiment in FIG. 7 and the bar-like member 34 according to the embodiment in FIG. 8.

Of course, various changes may be made to the embodiments of the present invention without departing from the spirits of the present invention.

What is claimed is:

1. A crane comprising:

a boom;

a jib that is provided on a leading end side of the boom; and a strut that is provided at one or both of a leading end portion of the boom and a base end portion of the jib, and to which a jib support pendant is connected, the strut, to which the pendant is connected, being provided with strut rotationally moving means having: a first bar-like member rotationally connected, at a first end portion thereof on one side, to a leading end portion of the strut on an opposite side thereof to a side, on which the pendant is connected; and a direct acting apparatus that applies, to the first bar-like member, a force pulling the first bar-like member toward the other side along a longitudinal direction of the first bar-like member.

2. The crane according to claim 1, wherein the strut rotationally moving means serves as a toggle mechanism in which an articulated portion is pushed and pulled by a force of the direct acting apparatus, this articulated portion being formed by connecting, in a stretchable manner, a second end portion of the first bar-like member, whose first end portion is connected to the leading end portion of the strut, with a second bar-like member which is different from the first bar-like member.

3. The crane according to claim 2, wherein the toggle mechanism pushes and pulls the articulated portion of the first bar-like member and the second bar-like member by means of an articulated-portion-driving toggle-mechanism having two link pieces joined together so as to rotate freely and a direct acting apparatus connected to a joining portion between the link pieces.

4. The crane according to claim 3, wherein a first link piece of the two link pieces of the articulated-portion-driving toggle-mechanism which is proximate to the strut provided with the strut rotationally moving means is provided so as to have a rotation center disposed coaxially with a rotation center of the strut, and the first link piece comprises means for removably locking the first link piece on the strut so that the first link piece is rotationally moved integrally with the strut.

5. The crane according to claim 1, wherein the first bar-like member, the first end portion of which is connected to the leading end portion of the strut, comprises a contraction mechanism provided in a middle of the longitudinal direction of the first bar-like member and enabling the first bar-like member to contract all over a length thereof.

* * * * *